US010562035B2

(12) United States Patent
Roth et al.

(10) Patent No.: US 10,562,035 B2
(45) Date of Patent: Feb. 18, 2020

(54) COUNTER-BLADE

(71) Applicant: Betek GmbH & Co. KG, Aichhalden (DE)

(72) Inventors: Markus Roth, Aichhalden (DE); Claus-Daniel Armbruster, Aichhalden-Roetenberg (DE)

(73) Assignee: Betek GmbH & Co. KG, Aichhalden (DE)

( * ) Notice: Subject to any disclaimer, the term of this patent is extended or adjusted under 35 U.S.C. 154(b) by 311 days.

(21) Appl. No.: 15/272,627

(22) Filed: Sep. 22, 2016

(65) Prior Publication Data

US 2017/0008005 A1 Jan. 12, 2017

Related U.S. Application Data

(63) Continuation of application No. PCT/EP2014/079169, filed on Dec. 23, 2014.

(30) Foreign Application Priority Data

Apr. 30, 2014 (DE) ..... 10 2014 106 037

(51) Int. Cl.
*B02C 18/18* (2006.01)
*B27L 11/00* (2006.01)

(52) U.S. Cl.
CPC ..... *B02C 18/18* (2013.01); *B27L 11/005* (2013.01); *B02C 2018/188* (2013.01); *B02C 2210/02* (2013.01)

(58) Field of Classification Search
CPC ..... B02C 18/02; B02C 18/04; B02C 18/18; B02C 18/186; B23C 5/2265; B23C 5/2437; B23C 5/2458; B23C 5/24; B23C 5/22; B27G 13/00; B27G 13/04; B27G 13/10
See application file for complete search history.

(56) References Cited

U.S. PATENT DOCUMENTS 5,549,025 A 8/1996 Müller
5,603,365 A * 2/1997 Stewart ..... B23C 5/04 144/230
6,094,795 A 8/2000 Davenport
7,703,714 B2 * 4/2010 Becker ..... B02C 18/18 241/242

(Continued)

FOREIGN PATENT DOCUMENTS

AT 398 509 B 12/1994
DE 44 02 111 A1 7/1995

(Continued)

OTHER PUBLICATIONS

International Search Report and Written Opinion (Application No. PCT/EP2014/079169) dated May 4, 2015.

*Primary Examiner* — Matthew Katcoff
(74) *Attorney, Agent, or Firm* — Burr & Brown, PLLC

(57) ABSTRACT

The present invention relates to a counter-blade, in particular, for a wood chipper, for producing wood chips, comprising at least one cutting edge made of a hard material, and a support surface leading to the cutting edge. According to the present invention, the cutting edge is made up of a plurality of hard material elements that are arranged next to one another along the cutting edge on a main member. This results in a counter-blade having a long service life.

16 Claims, 3 Drawing Sheets

(56) References Cited

U.S. PATENT DOCUMENTS

| | | | | |
|---|---|---|---|---|
| 9,144,804 | B2 * | 9/2015 | Kessler | B02C 18/14 |
| 9,764,398 | B2 * | 9/2017 | Tanaka | B23C 3/12 |
| 9,943,037 | B2 * | 4/2018 | Stanley | A01B 33/142 |
| 2011/0100383 | A1 | 5/2011 | Tilley et al. | |
| 2013/0099037 | A1 | 4/2013 | Moosmann et al. | |
| 2013/0168477 | A1 * | 7/2013 | Doppstadt | B02C 13/04 241/197 |

FOREIGN PATENT DOCUMENTS

| | | | |
|---|---|---|---|
| DE | 10 2010 016 498 | A1 | 10/2011 |
| EP | 0 640 449 | A1 | 3/1995 |
| JP | 2010-017638 | A1 | 1/2010 |

* cited by examiner

COUNTER-BLADE

CROSS REFERENCE TO RELATED APPLICATIONS

This application is a continuation of International Application No. PCT/EP2014/079169 filed Dec. 23, 2014, which designated the United States, and claims the benefit under 35 USC § 119(a)-(d) of German Application No. 10 2014 106 037.7 filed Apr. 30, 2014, the entireties of which are incorporated herein by reference.

FIELD OF THE INVENTION

The present invention relates to a counter-blade, in particular, for a wood chipper, for producing wood chippings, having at least one cutting edge which is formed from a hard material and one support surface which leads to the cutting edge.

BACKGROUND OF THE INVENTION

Shredding units, where rotating cutters are moved past a fixedly located counter-blade and the material is shredded between the rotating cutters and the counter-blade, are used for the shredding of biomaterials, for example, in agriculture or forestry, but also for the shredding of waste. Thus, DE 44 02 111 A1 describes a mobile waste shredding unit for reducing the volume of, for example, bulky waste, demolition wood, plastics materials and old tires as well as for organic waste materials, such as green cuttings, weak wood, etc. The shredding unit consists of a slow-running, cylindrical rotor, on which the cutters are mounted, and a beam-like counter-cutter arranged parallel to the rotor. The material to be shredded is fed to the shredding unit by means of a draw-in unit.

The cutters and the counter-blade are exposed to a high degree of wear are consequently replaceable. In order to obtain a long service life of the counter-blade, AT 398 509 B describes, for its use in a cutting machine, a cutting strip, the cutting edge of which is formed by two cutting surfaces (side face and top surface) which are located approximately at right angles to each other. Consequently, the side face is provided up to the cutting edge with a coating produced from a hard metal. A hard metal coating is also provided on the top surface, at a spacing from the cutting edge.

As a result of the hard metal coating, the service life of the counter-blade can be significantly increased. In this case, the gap between the cutting edge and the coating on the top surface brings about a self-sharpening effect as the softer material located in between wears more intensely whilst the cutting edge formed from hard material remains unchanged.

In the case of a hard metal, as a brittle material there is the risk of fracture when the counter-blade is stressed, for example, as a result of a material that is fed being very hard. The fracture, in this case, can run over the complete length of the counter-blade and as a result make the counter-blade unusable. However, even locally delimited outbreaks in the hard metal coating can result in the entire counter-blade having to be replaced prematurely as the desired cut size is no longer obtained overall.

SUMMARY OF THE INVENTION

It is consequently the object of the present invention to provide a counter-blade which has a long service life and additionally enables simple mounting.

The object of the present invention is achieved as a result of the cutting edge being formed from a plurality of hard material elements which are arranged on at least one basic body one next to another along the cutting edge.

The hard material elements, in this case, can preferably be produced from a hard metal. Such hard material elements show a very small level of wear, as a result of which the service life of such a counter-blade is significantly extended compared to a conventional counter-blade produced from steel. The realization of the cutting edge from a plurality of hard material elements arranged one next to the other provides the advantage that in the case of a possible fracture of one hard material element, the fracture does not run further into an adjacent hard material element. The damage, consequently, remains locally delimited such that it is possible to continue to use the counter-blade. Over and above this, in the case of a counter-blade edge that is segmented in this manner, a stress-optimized design in favor of a low risk of fracture can be achieved. The fastening of the hard material elements on the basic body is effected in short segments such that, for example, fastening irregularities due to tolerances only have a small influence on the component stresses introduced by means of the fastening. As the hard material elements are mounted on a basic body, the basic body, in the case of mounting or in the case of a necessary replacement, is able to be mounted simply and quickly in one operation together with the attached hard material elements. The use of small hard material elements provides the further advantage that they are able to be produced in a cost-efficient manner and in large quantities. As a result, the overall costs for a counter-blade provided with hard material can be kept down.

As already mentioned above, hard metal is suitable as the material for the hard material elements. Particularly suitable, in this case, are hard metals which have a cobalt content of between 3.0 and 25 percent by weight. In this case, a material composition which has a grain size in the hard metal material within the range of between 10 μm and 30 μm is particularly suitable. Such materials are particularly impact resistant and are suitable in a specific manner for wood shredding or the shredding of recycling materials.

Corresponding to a particularly preferred development variant of the present invention, it can be provided that in each case part of the hard material elements is arranged along an edge of the basic body and that the cutting edge is formed by the hard material elements of basic bodies arranged next to one another. A long counter-blade can consequently be formed by placing a plurality of basic bodies provided with hard material elements next to one another a row. In this case, standard basic bodies can be used in the manner of a construction kit to produce counter-blades of different lengths. The use of smaller, standard basic bodies provides the advantage that they are able to be used in a cost-efficient manner in smaller production units. A production error, for example, when soldering, leads simply to the rejection of one basic body and not of a whole counter-blade. In operation the advantage of designing the counter-blade from a plurality of basic bodies is that, where required, they are able to be replaced individually. Thus, for example, where the stress on the counter-blade is uneven, the basic bodies arranged in portions of the counter-blade that are particularly highly stressed and are correspondingly worn are able to be replaced prematurely whilst the basic bodies in less stressed regions continue to be used. Damaged basic bodies are able to be replaced individually in a corresponding manner.

A suitable cutting edge with good cutting results can be obtained as a result in that the hard material elements are configured in a cuboid or trapezoidal manner, that in each case a long edge of the cuboid or trapeze forms part of the cutting edge and that the cuboids or trapezes are arranged next to one another in a row along their surface delimited by their short edges. The cuboid hard material elements are able to be produced in a cost-efficient manner in large quantities and can easily be joined to the basic body, for example, by means of hard soldering. To this end, an arbitrary number of hard material elements can be placed in a row flush next to one another. As a result of the cuboid form, the material use of the high-quality hard material can be adapted optimally to the requirements such that the basic body, the hard material elements and further wear components of the counter-blade have approximately the same service life.

A more secure and durable fastening of the hard material elements on the basic body can be achieved in that along the cutting edge the basic body comprises a recess into which the hard material elements are admitted in a flush manner to form a front end face of the basic body and/or in a flush manner to form the support surface or that the hard material elements are admitted in such a manner into the recess that they project beyond the front end face and/or the support surface or that the hard material elements are admitted in such a manner into the recess that they are set back in relation to the support surface. The preferably cuboid hard material elements are consequently joined to the basic body in each case on two of their long sides such that they are not broken out of the bond even in the event of strong mechanical stress. If the hard material elements end flush with the support surface or if they are set back somewhat in relation to the support surface, they are not contacted by the material to be cut, which is fed over the support surface under an introduced pressing pressure, and sheared off by the basic body. If the hard material elements are arranged such that they end flush with the end face of the basic body or project somewhat beyond the end face of the basic body, a free cut surface is formed. The support for the hard material elements formed by the recess ends, in the case of this arrangement, flush or set back with respect to the hard material elements and is correspondingly protected from the passing material to be cut, as a result of which premature wear of the basic body is able to be avoided in this region.

Along with the cutting edge itself, the support surface, along which the material to be cut is fed to the cutting edge, is also exposed to great mechanical stresses in the direct vicinity of the cutting edge. In order to avoid increased wear on the basic body in the region, it can be provided that, along the hard material elements forming the cutting edge, the support surface comprises a plurality of protective elements which are arranged in a row next to one another, are produced from hard material and preferably join in a flush manner to the hard material elements or are arranged at a spacing of a gap from the hard material elements. The protective elements can be produced, for example, from abrasion-resistant hard metal. If the protective elements abut directly against the hard material elements, the top surface of the basic body is completely protected against wear in the region. The basic body being eaten away, which would result in weakening the support of the hard material elements, can consequently be prevented here. Following such erosion, there would be the risk of the hard material elements breaking prematurely. If a gap is provided between the hard material elements and the protective elements, the relatively soft material of the basic body is exposed here. As a result of increased abrasion in the region, the rear sides of the hard material elements are slowly exposed in operation, whilst the hard material elements are worn in a slower manner. The hard material elements form a free-standing cutting edge as a result. A self-sharpening effect for the cutting edge can be achieved in this manner as a result of the arrangement. In order to prevent excessive erosion of the basic body in this case, the gap region has to be dimensioned in dependence on the strength of the basic body.

The risk of breakage for the hard material elements and the protective elements can be further reduced in that the transitions between the protective elements are arranged in the direction of extension of the cutting edge so as to be spatially offset with respect to the transitions between the hard material elements.

The hard material elements are exposed to greater mechanical stress and consequently greater wear than the protective elements. In order to achieve a comparable service life for the hard material elements and the protective elements, it can be provided that, proceeding from the basic body, the material thickness of the hard material elements is chosen to be greater than the material thickness of the protective elements.

When the counter-blade is in use, it can occur that certain regions, for example, in the center of the counter-blade, are stressed mechanically more intensely and more frequently than other regions, for example, at the edge of the counter-blade. In the regions under the greater mechanical stress, there is increased wear on the counter-blade as a result. In order to achieve a comparable service life of the basic body and of the attached hard material elements and the protective elements over the entire length of the counter-blade, it can be provided that the material thickness of the hard material elements and/or the material thickness of the protective elements is chosen to be different for various basic bodies. In the regions under great mechanical stress, basic bodies can thus be provided with comparatively thick hard material elements or protective elements, whilst in regions of lower mechanical stress basic bodies can be provided with thin hard material elements or protective elements.

The material to be cut is guided over the support surface to the cutting edge under a high pressing pressure. In order to protect the basic body from wear in the region, it can be provided that the support surface is formed by in each case one cover plate which is mounted on each basic body and is joined directly or indirectly to the protective elements or the cutting edge. If the cover plate is worn prematurely compared to the hard material elements or the protective elements, it can be replaced separately and the basic body with the high-quality hard material components can continue to be used.

The basic body can preferably be formed from a comparatively soft and tough steel and the cover plate can be formed from a steel that is comparatively harder in relation thereto. The soft, tough steel of the basic body maintains its characteristics at the necessarily high temperatures during the soldering process for the attachment of the hard material elements and of the protective elements and brings about a high bending and tensile strength of the basic body when the counter-blade is in use. The comparatively hard cover plate produces the necessary low amount of wear on the support surface. The basic body can be produced, for example, from 42CrMo4, whilst the support surface can be produced from Hardox 400.

To position the protective elements during the soldering process during production and the cover plate when it is being mounted, it can be provided that the basic body realizes a web between the protective elements and the cover plate. The protective elements can be fixed on the web during production. The web forms a reservoir for the solder used such that it does not flow away. For the subsequent mounting of the cover plate, the cover plate can be placed onto the web. In this way, it is correctly aligned for fastening on the basic body.

In order to achieve as full a contact between the cover plate and the basic body as possible, it can be provided that the basic body, on the side remote from the cutting edge, realizes a support plane along which the cover plate is held in a flat manner. As a result of the full contact, breakage or deformation of the cover plate is avoided even in the case of great mechanical stress. The transition from the web to the support plane is preferably realized as a rounding and an edge of the cover plate has a chamfer in the region of the rounding. The rounding reduces stress peaks in the region of the transition from the web into the support plane. The achievement of the chamfer is that the cover plate is located freely in the region of the rounding and consequently rests over its entire surface along the support plane.

In order to be able to join the basic body securely and quickly to a carrier and the cover plates in each case to a basic body, it can be provided that the basic body comprises fastening receiving means for receiving fastening elements for fastening the basic body onto a carrier and that the cover plate comprises bores for receiving mounting screws for fastening the cover plate on the basic body, wherein in the mounted state the cover plate covers the fastening receiving means of the basic body. The fastening receiving means of the basic body are thus protected from wear by the cover plate.

For mounting the counter-blade, the basic bodies are first of all fastened on a carrier and the cover plates are then mounted on the basic body. The dismantling is effected in the reverse order. On account of contamination, for example, as a result of resinification, it can occur that the cover plate cannot be released from the basic body when being dismantled. Consequently, it can be provided that the cover plate comprises a forcing portion, preferably a threaded bore. The cover plate can be forced from the basic body by way of the forcing portion and can consequently be released. A simply producible realization, in this case, is provided by a threaded bore which penetrates the cover plate. For dismantling, a screw, which presses on the basic body located below it and lifts the cover plate from the basic body, can be rotated in the threaded bore.

In an alternative development of the present invention, it can be provided that the basic body comprises a second cutting edge. The second cutting edge can be formed correspondingly to the first cutting edge from hard material elements which are arranged in a row one next to another, preferably of the same hard material elements as are used for the first cutting edge. Counter-blades with two cutting edges can be formed from the basic bodies, as are used in the case of various shredding units.

Corresponding to a particularly preferred realization variant of the present invention, it can be provided that the basic body comprises a positioning receiving means or a positioning attachment for receiving a positioning attachment or a positioning receiving means arranged on the carrier. When the basic body is mounted, the positioning attachment engages in the positioning receiving means. As a result, the position of the basic body is set and fixed in relation to the carrier. This is, in particular, advantageous when replacing a basic body during an assignment of the shredding unit as the replacement can be carried out quickly and correctly even under unfavorable conditions and the assembly times of the unit can thus be kept very short.

Simple positioning of the basic body in relation to the carrier can be achieved in that the positioning receiving means or the positioning attachment is arranged along an end-face stop surface of the basic body located opposite the cutting edge or that the positioning receiving means or the positioning attachment is arranged along a mounting plane of the basic body located opposite the support plane. For mounting, the basic body is placed in such a manner onto the carrier that the positioning attachment engages in the positioning receiving means such that the basic body is able to be joined to the carrier by means of the fastening elements.

In order also to be able to align and mount the cover plate quickly and securely in relation to the carrier and to the basic body mounted thereon, it can be provided that cover plate comprises a positioning receiving means and/or a positioning attachment on its end face remote from the cutting edge. The positioning attachment then engages in a corresponding positioning receiving means on the carrier, or a positioning attachment provided on the carrier engages in the positioning receiving means of the cover plate such that the cover plate is aligned precisely on the basic body.

BRIEF DESCRIPTION OF THE INVENTION

The present invention is explained in more detail below by way of an exemplary embodiment shown the drawings, in which.

DETAILED DESCRIPTION OF THE INVENTION

Figure 1:
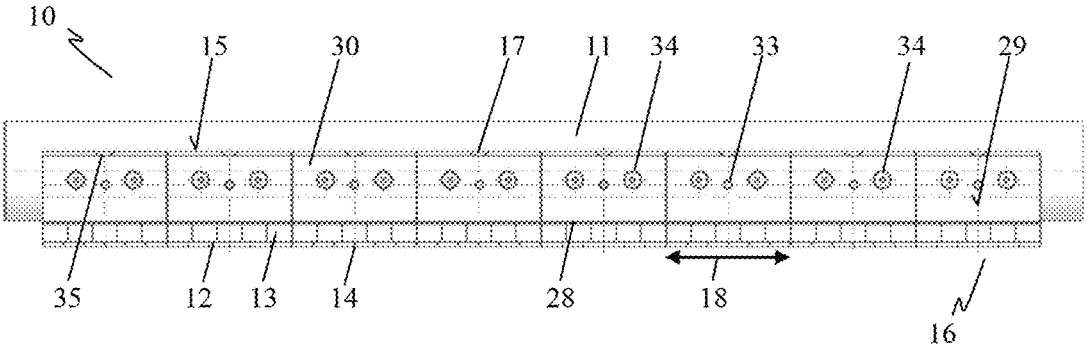
FIG. 1 shows a top view of a counter-blade 10 with one cutting edge.

FIG. 1 shows a top view of a counter-blade 10 with one cutting edge.

Figure 2:
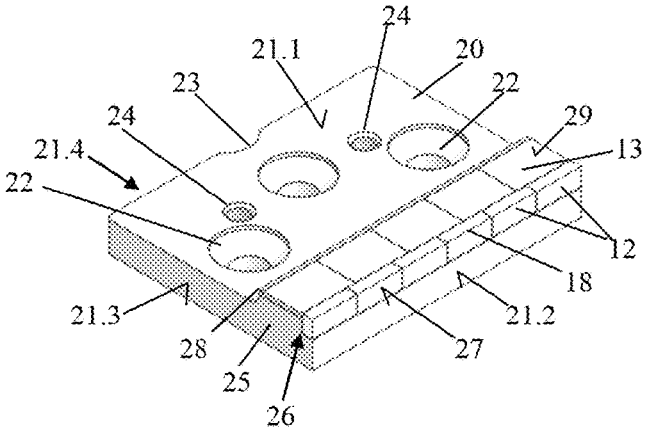
FIG. 2 shows a perspective front view of a basic body of the counter-blade with a cutting edge portion.
Figure 3:
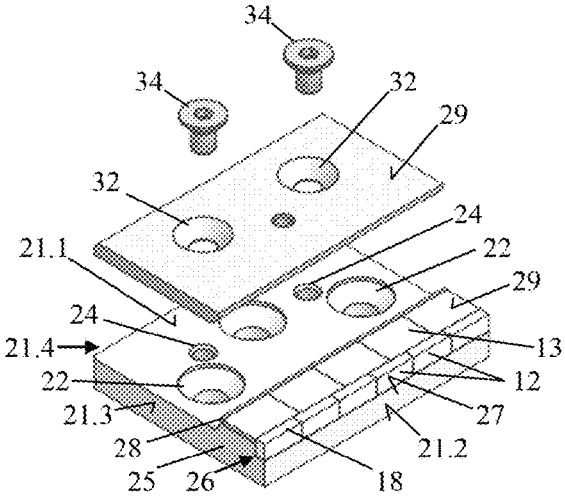
FIG. 3 shows the representation according to FIG. 2 as an exploded drawing with a cover plate.
Figure 5:
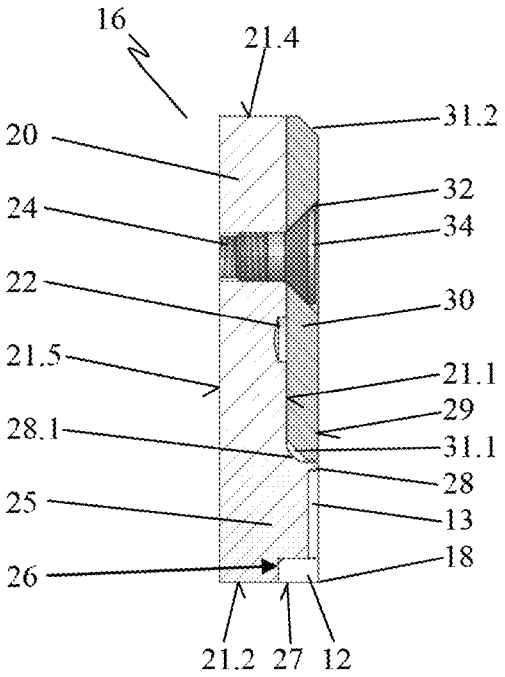
FIG. 5 shows a side view of the segment of the counter-blade shown in FIG. 4.

The cutting edge 14 is formed from a row of cuboid hard material elements 12 which are arranged along the cutting edge 14. Protective elements 13, offset in relation to the hard material elements 12, are arranged joining directly to the hard material elements 12. The protective elements are also formed from a hard material. In the exemplary embodiment shown, the hard material elements 12 and the protective elements 13 are produced from hard metal. Separated by a narrow web 28, following the protective elements 13, cover plates 30 are fastened, each with two mounting screws 34, on in each case one basic body 20 which is concealed by the cover plates 30, the protective elements 13 and the hard material elements 12, as is shown in FIGS. 2, 3 and 5. The hard material elements 12, together with the cover plates 30 and the web 28 arranged in between, form a support surface 29 which leads to the cutting edge 14.

With the protective elements 13 and hard material elements 12 arranged in rows thereon, a cover plate 30 shows the outline of a segment 16 of the counter-blade 10. The counter-blade 10 is formed, in the exemplary embodiment shown, from eight segments 16 arranged in a row next to one another. The segments 16 are fastened on a carrier 11 for this purpose. In each case six hard material elements 12 per segment 16 form, in this case, a cutting edge portion 18 which is marked by a double arrow, the cutting edge portions 18 which are arranged in a row next to one another provide the cutting edge 14.

Along a stop face 15, against which the segments 16 abut at the rear on a corresponding wall of the carrier 11, the carrier comprises positioning attachments 17. The positioning attachments engage in positioning receiving means 23, 35 mounted on the basic body 20 and the cover plate 30, as is shown in more detail in FIGS. 2 and 4.

A continuous threaded bore 33 is provided in each cover plate 30 between the mounting screws 34.

During mounting, the basic bodies 20 are fastened on the carrier 11 in such a manner that the cutting edge 14 protrudes beyond the carrier 11. In this case, the positioning attachments 17 and the positioning receiving means 23 serve for the quick and precise alignment of the individual basic bodies 20 in relation to the carrier 11. The cover plates 30 are then mounted on the basic bodies 20. Here too, the second positioning receiving means provided on the cover plate 30 serves for the simple positioning of the cover plate 30 in relation to the carrier 11 and consequently in relation to the already mounted basic body 20. Provided with the segments 16 of the counter-blade 10, the carrier 11 can then be mounted, for example, on a wood chipper to create wood chippings, in such a manner, that the cutting edge 14 is located opposite cutters which are arranged on a rotating roller of the wood chipper and are moved past the counter-blade 10.

In operation, the wood to be shredded is fed by corresponding conveyor units beyond the support surface 29 to the cutting edge 14. The cutters of the wood chipper (not shown) are moved past the cutting edge 14 coming from the viewing direction in the representation. Wood which protrudes beyond the cutting edge 14 is shredded in this case.

The cutting edge 14 is advantageously formed from a plurality of hard material elements 12. Hard material elements 12 show a low amount of wear, as a result of which a long service life of the counter-blade 10 is achieved. As a result of the small size of the individual hard material elements 12, the bending stress of the individual hard material elements 12 is low such that fractures are able to be extensively avoided. Should a hard material element 12, nevertheless break, for example, caused by great mechanical stress by a hard material inadvertently being introduced into the cutting gap, the breakage is limited to the relevant hard material element 12 and does not progress further into the adjacent hard material element 12. As a result of the design of the counter-blade 10 from a plurality of adjacently arranged hard material elements 12, an extended breakage along the cutting edge 14 formed from hard metal can consequently be avoided and the counter-blade 10 can continue to be used. If, nevertheless, there is greater damage to a cutting edge portion 18 or if a cutting edge portion 18 is worn prematurely as a result of irregular stress along the cutting edge 14, the relevant segment 16 is able to be individually replaced. To this end, firstly the cover plate 30 is separated from the basic body 20 and then the basic body 20 is separated from the carrier 11. If the cover plate 30 cannot be separated from the basic body 20, for example, on account of heavy contamination or resinification, a screw can be screwed into the threaded bore 33 and, as a result, the cover plate 30 can be pressed away from the basic body 20. A new basic body 20 can then be mounted onto the carrier 11 at the free position and a cover plate 30 can be attached. As a result of simple centering by means of the positioning receiving means 23, 35 and the positioning attachments 17, one or several segments 16 can be changed very rapidly. Together with the long service life, which corresponds to between ten and twelve times the service life of a normal steel counter-blade, very few maintenance-related machine stoppages can thus be achieved. As a result of being able to replace individual segments 16, the spare parts costs can be kept low. The small amount of wear of the hard material elements brings about a constant cutting performance of the counter-blade 10 over a long period of time. This leads to constant quality of the chipped material. In addition, as a result of the high cutting performance, lower energy consumption and consequently reduced operating costs are achieved for the shredding unit. This is noticeable, in particular, in mobile usage by reduced fuel consumption, which along with reduced costs also leads to less environmental pollution.

The front region of the support surface 29, which faces the cutting edge 14 and is under particular mechanical stress, is also protected from premature wear by the protective elements 13. As a result of using a plurality of protective elements 13 arranged in rows next to one another and as a result of the lateral offset in relation to the hard material elements 12 arranged in front thereof, the risk of breakage is reduced here too and a breakage is prevented from spreading further.

FIG. 2 shows a perspective front view of a basic body 20 of the counter-blade 14 with a cutting edge portion 18.

The basic body 20 is produced from a relatively soft, tough steel, for example, from 42CrMo4. In the front region it forms a supporting part 25, on which the hard material elements 12 and the protective elements 13 are soldered. A recess 26, into which the cuboid hard material elements 12 are admitted, is formed toward a front end face 21.2 in the supporting part 25. The front sides of the hard material elements 12, in this case, end with the front end face 21.2 of the basic body and, proceeding from the cutting edge portion 18, form a cutting surface 27. The top surface of the hard material elements 12 ends flush with the top surface of the protective elements 13 which join to the hard material elements 12. The top surface of the protective elements 13 forms a portion of the support surface 29. The protective elements 13 are arranged flush between the hard material elements 12 and the web 28. The web 28, in this case, serves for positioning and mounting the protective elements 13, in particular, during the soldering process during production.

A support plane 21.1, which is placed in a recessed manner compared to the support of the protective elements 13, is provided following the web 28. Proceeding from the support plane 21.1, the basic body 20 is penetrated by three fastening receiving means 22, which are realized as counter bores and are arranged offset, and two threaded receiving means 24.

The basic body 20 is delimited at the side by two side faces 21.3 which extend in a plane-parallel manner and on which the basic bodies 20 are located next to one another in their arrangement on the carrier 11.

At the rear, the basic body 20 ends in a rear end-face stop face 21.4, in the center of which the positioning receiving means 23 is preferably recessed as a wedge-shaped recess.

The basic body 20 consequently forms the basis for a segment 16 of the counter-blade 10. The basic body 20 can be mounted simply and securely on the carrier 11 by means of the fastening receiving means 22 with the aid of screws. As a result of the countersinking applied on the fastening receiving means 22, the screws can be arranged in a recessed manner such that they do not protrude beyond the support plane 21.1. A cover plate 30 shown in FIG. 1 can thus be placed onto the support plane 21.1 of the basic body 20 and tightened at the threaded receiving means 24.

The soft steel used maintains its characteristics during the process of soldering the hard material elements 12 and the protective elements 13.

FIG. 3 shows the representation according to FIG. 2 as an exploded drawing with a cover plate 30. The cover plate 30, in this case, is arranged above the basic body 20 described in FIG. 2. Proceeding from its top surface, it is penetrated by two countersunk bores 32, with which two mounting screws 34 are associated. In addition, the threaded bore 33 is guided through the cover plate.

The dimensions of the cover plate 30 are chosen so as to match the dimensions of the support surface 21.1 of the basic body 20. The bores 32 are arranged in such a manner that, with the cover plate 30 placed in position, they are aligned with the threaded receiving means 24 of the basic body 20. The mounting screws 34 can thus be guided through the bores 32 and screwed into the threaded receiving means 24. As a result, the cover plate 30 is fixedly joined to the basic body 20.

In the mounted state, the screw heads of the mounting screws 34 are arranged countersunk in the cover plate 30. The top surface of the cover plate 30 consequently forms, with the connecting web 28 and the top surface of the protective elements 13, a continuous, flat support surface 29, along which the material to be cut can be fed to the cutting edge portion 18 and consequently to the cutting edge 14.

The fastening receiving means 22 and the screws inserted therein for mounting the basic body 20 onto the carrier 11 are covered by the cover plate 30 and as a result are protected from wear. The cover plate 30 itself is produced from a steel which is harder when compared with the basic body 20 but is nevertheless tough, for example, from Hardox 400. As a result, the support surface 29 is realized in a continuously wear-protected manner. Should the cover plate 30 nevertheless wear prematurely or become damaged, it can be replaced separately and the high-quality hard metal components can continue to be used.

Figure 4:
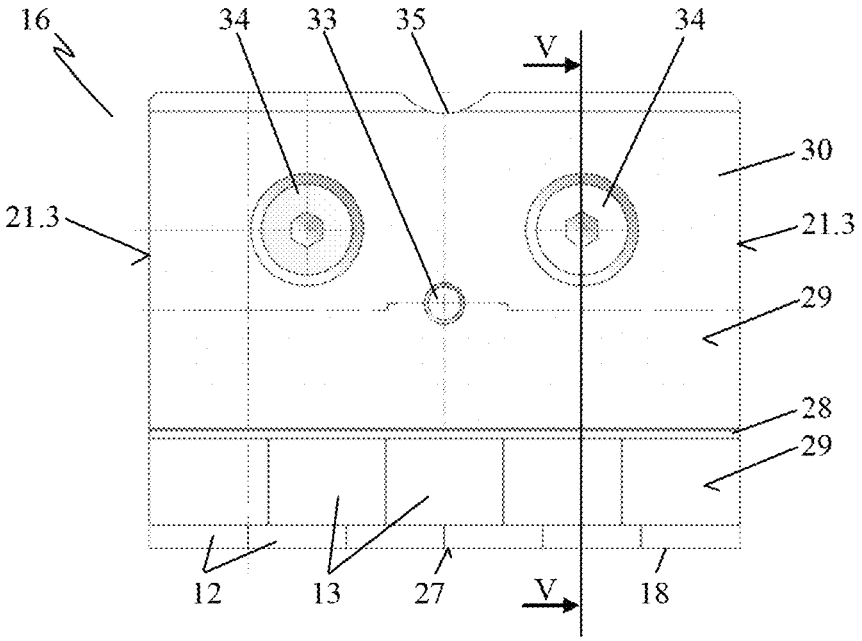
FIG. 4 shows a top view of a segment of the counter-blade.

FIG. 4 shows a top view of a segment 16 of the counter-blade 10 in the assembled state. The cover plate 30 is held in the basic body 20 by the mounting screws 34 which are arranged in a countersunk manner. It ends toward the protective elements 29 on the web 28. The top surface of the segment 16 consequently forms a continuous support surface 29 up to the cutting edge portion 18. On the side of the cover plate 30 remote from the web, the second positioning receiving means 35 is molded in the form of a wedge-shaped recess. This extends congruently with respect to the positioning receiving means 23 of the basic body 20 which is located below it. The segment 16 can consequently be aligned simply and quickly in a positionally precise manner in relation to the carrier 11 by the positioning receiving means 23, 35 of the basic body 20 and of the cover plate 30 being slid onto a positioning attachment 17 of the carrier 11.

FIG. 5 shows a side view of the segment 16 of the counter-blade 10 shown in FIG. 4 along a line of intersection marked by way of V-V in FIG. 4.

The cover plate 30 is held on the basic body 20 by way of the mounting screw 34. In the transition from the web 28 to the support plane 21.1, the basic body 20 forms a rounding 28.1. The edge of the cover plate 30 shows a first chamfer 31.1 in the region of the rounding 28.1 such that the cover plate 30 is able to be placed flush onto the support plane 21.1 of the basic body 20. As a result of the rounding 28.1, stress peaks are reduced in the region of the transition from the web 28 into the support plane 21.1.

The cover plate 30, the web 28, the protective elements 13 and the hard material elements 12 form a continuous support surface 29 which, in the mounted state, merges in a flush manner into a corresponding surface of the carrier 11. The material to be cut can consequently be fed via the surface of the carrier 11 and the support surface 29 to the cutting edge portion 18 and consequently to the cutting edge 14. A second chamfer 31.2 is provided on the cover plate 30 in the transition from the support surface 29 to the corresponding surface of the carrier 11. The second chamfer prevents, for example, on account of production tolerances or abrasion of the carrier 11, a step being formed between the surface of the carrier and the support surface 29, on which more wear then occurs as a result of the material to be cut being guided over it. As an alternative to the second chamfer 31.2, the edge of the cover plate 30 can also be realized rounded over a radius. A particularly break-resistant edge which withstands very great stresses is obtained as a result of a radius.

A basic body bottom surface 21.5 of the basic body 20 is realized as a flat surface which is arranged in a plane-parallel manner with respect to the support surface 29. The basic body 20 is able to rest thereon along a mounting plane on a corresponding counter surface of the carrier 11.

Figure 6:
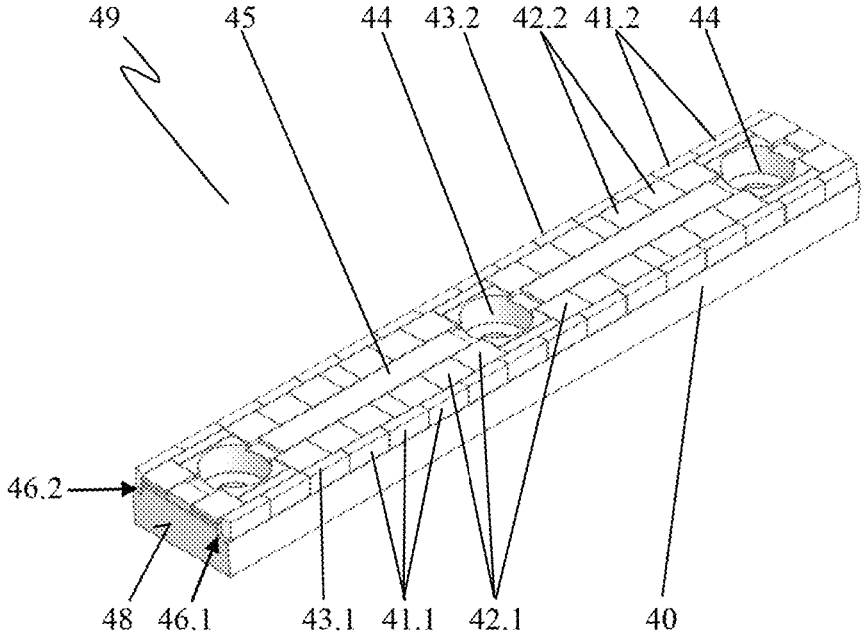
FIG. 6 shows a second segment of a counter-blade with two cutting edges.

FIG. 6 shows a second segment 49 of a second counter-blade (not shown) with two cutting edges.

A second basic body 40 is realized as a substantially elongated cuboid. Along two oppositely situated long edges of the cuboid, the second basic body 40 comprises a front recess 46.1 and a rear recess 46.2 into which front hard material elements 41.1 and rear hard material elements 41.2 are inserted. In each case a row of front protective elements 42.1 and rear protective elements 42.2, which are also produced from a hard material, are arranged joining to the hard material elements 41.1, 41.2. In the exemplary embodiment shown, the front and rear hard material elements 41.1, 41.2 and the front and rear protective elements 42.1, 42.2 are produced from hard metal. A second web 45, which is integrally molded onto the second basic body 40, is arranged between the rows of the protective elements 42.1, 42.2. Second fastening receiving means 44 in the form of stepped bores, which penetrate the basic body 40, are provided along the second web 45. The top surfaces of the front and rear hard material elements 41.1, 41.2, of the front and rear protective elements 42,1. 42.2 and of the second web 45, form a flat second support surface 47. The front and rear holding elements 41.1, 41.2 provide a front cutting edge portion 43.1 and a rear cutting edge portion 43.2.

The second basic bodies 40 can be arranged in a row one next to another on a carrier (not shown) and joined to the carrier by way of screws which are guided through the second fastening receiving means. For secure positioning of the second basic bodies 40, positioning attachments or positioning receiving means which engage in corresponding positioning receiving means or positioning attachments of the carrier, can be provided on the bottom surface of the second basic bodies. The bottom surface of the second basic body 40 forms with the top surface of the carrier a mounting plane in which the positioning receiving means and positioning attachments are arranged. The second basic bodies 40 each comprise two short-side end faces 48 which are realized in a flat manner such that the second basic bodies 40 are able to be arranged flush in rows next to one another on the carrier. The front and rear cutting edge portions 43.1, 43.1 of the second segments 49 which are arranged in rows next to one another form a front and a rear cutting edge of the second counter-blade.

In operation, cutters are moved past each of the two cutting edges. Material to be cut which is introduced into the region of the cutting edges is thus shredded between the cutting edges and the cutters moving past.

In the realization variant too, the inserted small hard material elements 41.1, 41.2 and protective elements 42.1, 42.2 result in a long service life of the second counter-blade. Breakages in one of the hard metal components are not passed onto the next hard metal component. When required, individual second segments 49 can be replaced quickly. In this case, the positioning receiving means and positioning attachments mounted in the mounting plane between the bottom surface of the second basic body 40 and the carrier enable quick and precise positioning of the replacement segments.

In an alternative embodiment (not shown) of the representations shown in FIGS. 1 to 5, the cover plates 30 can be arranged offset to the side in such a manner with respect to the basic bodies 20 that the abutment edges between the basic bodies 20 arranged in a row next to one another, formed along the side faces 21.3, are covered by the cover plates 30. A cover plate 30 is then screwed at one of its bores 32 with a first base plate 30 and at its second bore 32 with an adjacent second base plate 30. In each case, the outermost of the base plates 30 arranged on a counter-blade 10 are realized in a shortened or lengthened form, for example, with half a width or one and a half widths of a basic body 20 measured in the direction of the longitudinal extension of the counter-blade. Advantageous in this connection is that a continuous gap, into which waste material can be pressed, is not formed up to the carrier 11 between the cover plates 30 and the basic bodies 20.

The invention claimed is:

1. A counter-blade comprising a plurality of segments fastened on a support surface, the support surface having at least a first edge, and arranged in a row next to one another, each segment comprising a basic body fastened on the support surface and having a second edge extending past the first edge, a plurality of adjacent first elements provided on the second edge, the plurality of adjacent first elements comprising a first material having at least one of a wear resistance greater than a wear resistance of steel, a cobalt content of between 3.0 and 25 percent by weight, and a grain size within a range of 10 μm and 30 μm, defining a cutting edge each two adjacent first elements having a first transition defined therebetween, and a plurality of adjacent protective elements provided on the second edge joined in a flush manner to the adjacent first elements or arranged spaced by a gap away from the plurality of first elements, the plurality of adjacent protective elements comprising a second material which is one of the same as the first material or different from the first material, each two adjacent protective elements having a second transition defined therebetween, wherein each of the second transitions between each two of the adjacent protective elements are arranged in a direction of an extension of the cutting edge so as to be spatially offset with respect to the first transitions between each two of the adjacent first elements.

2. The counter-blade as claimed in claim 1, wherein the first elements are configured as geometric shapes, each geometric shape including a first edge defining a part of the cutting edge, and a second edge having a length less than a length of the first edge, and the geometric shapes are arranged next to one another in a row along a surface delimited by their second edges.

3. The counter-blade as claimed in claim 1, wherein at least one of the basic bodies comprises a recess into which the first elements are admitted in a flush manner to define a front end face of the at least one basic body or in a flush manner to define a substantially planar surface, or the first elements are admitted in such a manner into the recess that they project beyond the front end face.

4. The counter-blade as claimed in claim 1, wherein a material thickness of the first elements is chosen to be greater than a material thickness of the protective elements.

5. The counter-blade as claimed in claim 1, wherein one of a material thickness of the first elements or a material thickness of the protective elements is chosen to be different for at least one of the basic bodies.

6. The counter-blade as claimed in claim 1, wherein further comprising a cover plate that is mounted on the at least one basic body and is connected directly or indirectly to the protective elements or the cutting edge.

7. The counter-blade as claimed in claim 6, wherein the at least one basic body comprises a first steel and the cover plate comprises a second steel, the second steel having a hardness greater than a hardness of the first steel.

8. The counter-blade as claimed in claim 6, wherein the at least one basic body defines a web between the protective elements and the cover plate.

9. The counter-blade as claimed in claim 6, wherein the at least one basic body, on the side remote from the cutting edge, defines a support plane along which the cover plate is held in a flat manner.

10. The counter-blade as claimed in claim 6, wherein at least one basic body comprises at least one hole defined therein, configured to receive at least one fastening element, the at least one fastening element being configured to fasten the at least one basic body onto a carrier, and the cover plate comprises bores for receiving mounting screws for fastening the cover plate on the at least one basic body, wherein in the mounted state the cover plate covers the at least one hole defined in the at least one basic body.

11. The counter-blade as claimed in claim 6, wherein the cover plate comprises a forcing portion.

12. The counter-blade as claimed in claim 1, further comprising a second cutting edge.

13. The counter-blade as claimed in claim 1, wherein at least one basic body comprises a notch defined in a portion thereof, configured to receive a notch defined on a portion of a carrier, or a positioning attachment configured to receive a positioning attachment on the carrier.

14. The counter-blade as claimed in claim 13, wherein the notch, or the positioning attachment, is arranged along an end-face stop surface of the at least one basic body located opposite the cutting edge, or the notch, or the positioning attachment, is arranged along a mounting plane of the at least one basic body.

15. The counter-blade as claimed in claim 6, wherein the cover plate comprises a notch or a positioning attachment on an end face thereof spaced away from the cutting edge.

16. The counter-blade as claimed in claim 11, wherein the forcing portion is a threaded bore.

* * * * *